United States Patent [19]

Kobayashi

[11] Patent Number: 4,625,352

[45] Date of Patent: Dec. 2, 1986

[54] IMPLEMENT FOR FASTENING SHEET TO MAT

[76] Inventor: Mikizo Kobayashi, 19, Nanpeidai 8-chome, Shibuya-ku, Tokyo 150, Japan

[21] Appl. No.: 645,323

[22] PCT Filed: Dec. 24, 1983

[86] PCT No.: PCT/JP83/00452

§ 371 Date: Aug. 24, 1984

§ 102(e) Date: Aug. 24, 1984

[30] Foreign Application Priority Data

Dec. 24, 1982 [JP] Japan ..... 57-201644[U]

[51] Int. Cl.[4] ..... A47C 21/02; A47D 7/06

[52] U.S. Cl. ..... 5/498; 24/72.5

[58] Field of Search ..... 5/498, 495, 496, 497; 24/72.5, 304, 448, 445, 67.11, 545, 546, 563

[56] References Cited

U.S. PATENT DOCUMENTS

| | | | |
|---|---|---|---|
| 1,580,459 | 4/1926 | Westland | 24/67.11 |
| 1,892,841 | 1/1933 | Kaufmann | 24/72.5 |
| 1,948,965 | 2/1934 | Hart | 24/72.5 |
| 1,959,920 | 5/1934 | Kaiser | 5/498 |
| 1,972,919 | 9/1934 | Chambless | 5/498 |
| 2,109,652 | 3/1938 | Sallop et al. | 24/72.5 |
| 2,256,107 | 9/1941 | Zadek | 24/72.5 |
| 2,329,974 | 9/1943 | Bennett | 24/67.11 |
| 2,896,226 | 7/1959 | Swicegood et al. | 5/498 |
| 3,066,321 | 12/1962 | Kintner | 5/498 |
| 3,296,668 | 1/1967 | Aiken | 24/72.5 |
| 3,973,282 | 8/1976 | May | 24/72.5 |
| 4,395,797 | 8/1983 | May | 24/72.5 |
| 4,467,504 | 8/1984 | Quist | 24/72.5 |

FOREIGN PATENT DOCUMENTS

| | | | |
|---|---|---|---|
| 45-10985 | 2/1970 | Japan | 5/498 |
| 49-149117 | 12/1974 | Japan | 5/498 |
| 51-40507 | 3/1976 | Japan | 5/498 |
| 56-49499 | 11/1981 | Japan | 5/498 |
| 314254 | 6/1929 | United Kingdom | 5/498 |

*Primary Examiner*—Robert L. Wolfe
*Assistant Examiner*—Vinh Luong
*Attorney, Agent, or Firm*—Cushman, Darby & Cushman

[57] ABSTRACT

An implement for fastening a sheet to a mat comprises a cover body formed with an opening for inserting the mat on one surface to be mounted on the longitudinal ends of the mat, and a sheet clamping member fixed on the opening side of the upper surface of said cover body. The implements are mounted on both ends of the mat. Subsequently, the ends of the sheet are clamped with the sheet clamping member, so that the sheet is fastened to the mat.

1 Claim, 15 Drawing Figures

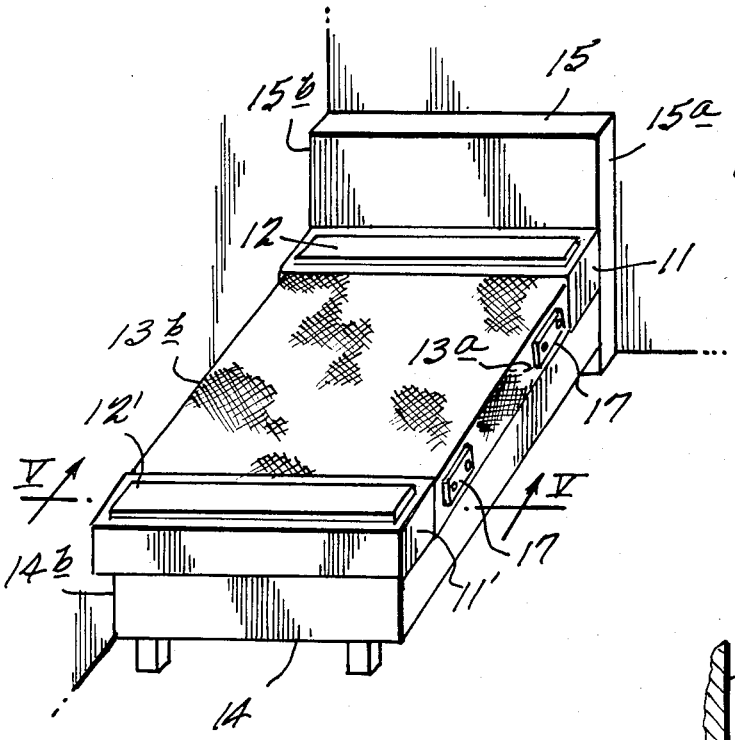
FIG. 4
FIG. 5
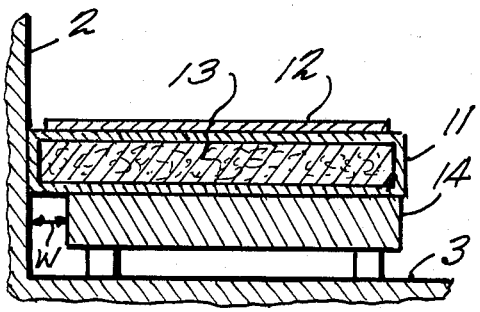
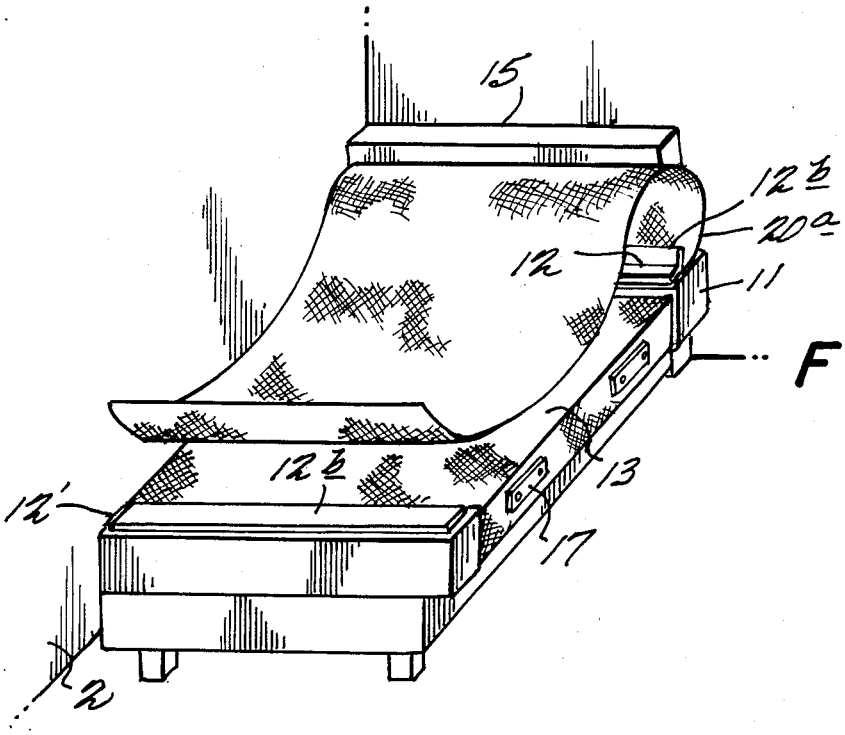
FIG. 6

IMPLEMENT FOR FASTENING SHEET TO MAT

TECHNICAL FIELD OF THE INVENTION

The present invention relates to an implement to be attached to the ends of a mat or mattress for fastening the ends of a sheet onto the ends of the mat.

A bed 1 for hotel use generally has, as shown in FIG. 1, a bed base 4 and a mat 5 placed on the base 1. Such a bed 1 has at least one side (i.e., lateral one side) thereof contacted with a wall surface 2 when installed in a relatively narrow room as in a so-called business hotel. (Numeral 3 designates a floor surface in the room.) Thus, the bed base 4 and the mat 5 are substantially contacted at one side thereof with the wall surface 2 in the room.

Heretofore, in order to fix a lower bed sheet 6 onto the upper surface of the mat 5, the ends 6*a* of the sheet 6 must be folded underneath the mat 5 and tuck in between the base 4 and the mat 5 so as to prevent the sheet 6 from being displaced and removed from the mat 5 due to the weight of a person laid on the mat or his turning over in sleep.

However, since one side of the bed 1 is contacted with the wall surface 2, it is necessary for tucking the ends 6*a* of the sheet 6 in between the base 4 and the mat 5 at the bed side on which the bed is thus contacted with the wall surface 2 for a worker either to ride on the mat 5 and to then raise the side of the mat 5 on the wall surface 2 or to pull the entire bed 1 off the wall surface.

The work of tucking the end 6*a* of the sheet 6 in between the base 4 and the mat 5 during raising the side of the mat 5 while riding on the mat 5 is very complicated, takes a plenty of time and bears a heavy load since the mat 5 is very heavy. Further, the work of pulling the entire bed 1 off the wall surface, laying the sheet 6 thereon and then returning the bed 1 to the wall surface 2 causes heavy labor due to much gravity of the bed 1. In addition, if the room is narrow for such work, it is also inconveniently necessary to move a desk, chairs and other furnitures so as to pull the bed 1 off the wall surface, and the floor surface 3 (or the carpet laid on the floor surface 3) tends to be broken due to the movement of the bed 1.

SUMMARY OF THE INVENTION

It is an object of the present invention to provide an implement for fastening a sheet to a mat, which can eliminate the aforementioned disadvantages and drawbacks of the conventional mat and can simply attach a sheet on the mat. The sheet fastening implement according to the present invention is provided with a resilient sheet clamping member and is adapted to be mounted on one end of the mat. The sheet fastening implements are mounted on both ends of the mat. Clamping a sheet with the sheet clamping member facilitates a sheet attaching work manifold.

The sheet fastening implement according to the present invention can be hence simply mounted on the mat, the sheet can be extremely simply and readily mounted on the mat body in a firm manner. Thus, it is not necessary to tuck the end of the sheet in between the mat and the bed body as the conventional one. Therefore, when the mat incorporating the sheet fastening implement according to the invention is used as the bed, the worker can be released from the conventional heavy works of riding on the mat or pulling the entire bed off the wall surface and then returning the bed to the wall surface. Further, it is not necessary even in a narrow room to move other furnitures, the bed making work can be remarkably simplified, and can be performed easily and regularly in much shorter times than before. Since the bed base need not be moved, the floor surface 3 is less liable to be damaged. In addition, since the end of the sheet is not tucked in between the mat and the bed base, even when the used sheet is removed from the bed, the sheet may be readily removed, and the sheet is exempt from damage. Since the sheet fastening implement can be fabricated in a mass production in various sizes and can be simply mounted on the existing mat, this advantageous precludes the necessity of newly manufacturing mats equipped with a sheet clamping member, so that the present invention can be used in simple and less costly manner for a wide range of uses. Moreover, since the sheet fastening implement according to the present invention can be simply mounted on and dismounted from the mat, the mat can be used with its back surface up, thereby increasing the lifetime of the mat and thus reducing the cost of the mat. It goes without saying that, when the mat is damaged, only the mat may be replaced economically.

BRIEF DESCRIPTION OF THE DRAWINGS

FIG. 4 is a perspective view of a bed incorporating the mat on which the sheet fastening implement according to the invention is mounted;

FIG. 5 is a sectional view taken along the line V—V in FIG. 4;

FIGS. 6 to 13 are perspective views showing the sequence of the work of making the bed incorporating the mat on which the sheet fastening implement according to the invention is mounted;

BEST MODE FOR CARRYING OUT THE INVENTION

The present invention will now be described in more detail with reference to the accompanying drawings.

Figure 1:
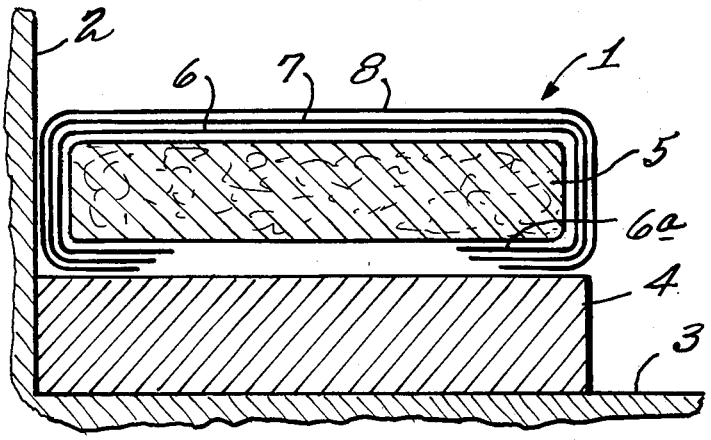
FIG. 1 is an explanatory view showing a bed making in a conventional bed.
Figure 2:
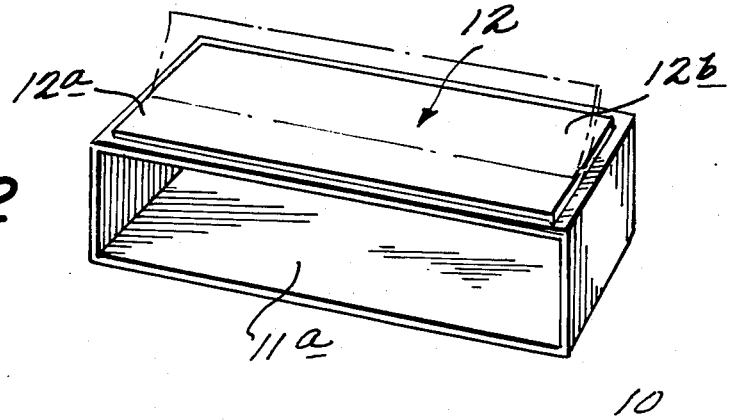
FIG. 2 is a perspective view showing a sheet fastening implement according to the present invention.

FIG. 2 is a perspective view showing an implement 10 for fastening a sheet to a mat according to an embodiment of the present invention. Numeral 11 designates a sheet fastening implement body or case body designed to be mounted on the end of a mat 13. The implement body 11 has a hollow rectangular parallel-piped having an opening 11*a*, to which the end of the mat 13 is inserted, formed on one end surface thereof, and a sheet clamping member 12 of strip plate shape is mounted substantially over the entire length on the upper surface side thereof. This member 12 is formed of a material having resiliency. This member is provided with a mounting portion 12*a* on the opening 11*a* side relative to the lateral center thereof. The mounting portion 12*a* is fastened by suitable means such as sewing or bonding to the case body.

Thus, as shown by broken lines in FIG. 2, the free portion 12b of the member 12 can be raised upwardly, and when released from the raising force, the member 12 is restored by its own resiliency into close and firm contact with the case body 11.

Figure 3:
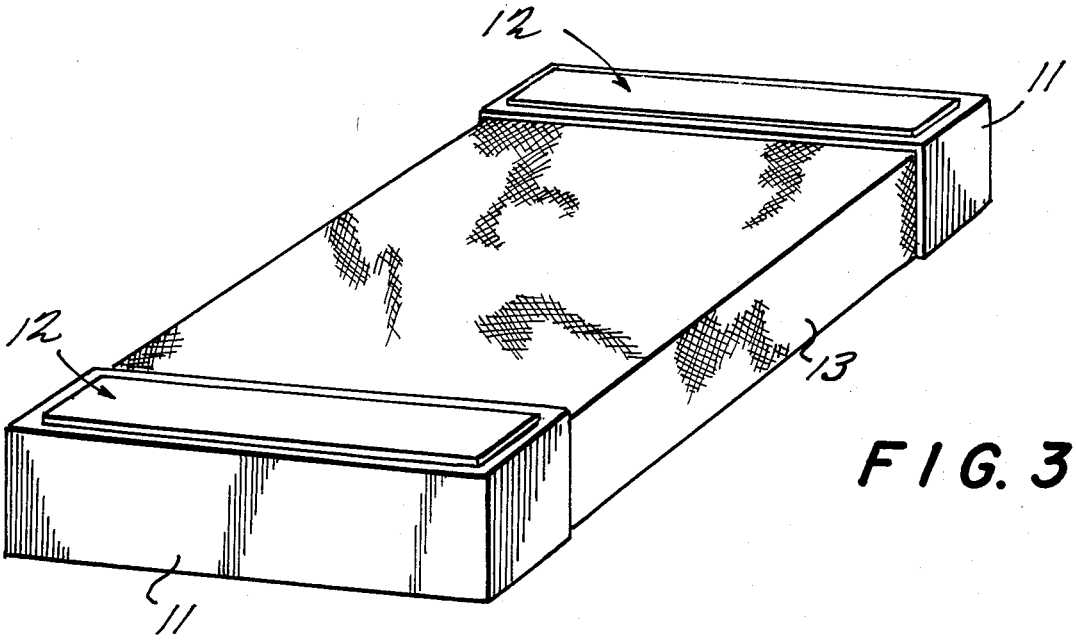
FIG. 3 is a perspective view of a mat on which the sheet fastening implement according to the present invention is mounted.

FIG. 3 is a perspective view showing that the sheet fastening implements 10, 10 are mounted on bodh ends of the mat 13. FIG. 4 is a perspective view showing a bed incorporating the mat 13 on which the sheet fastening implements 10, 10 are mounted.

In FIG. 4, numeral 14 designates a bed base. A side plate 15 is provided on the head side of the base 14. As shown in FIG. 5, the side face 15a, opposite to the wall surface 2 of the side plate 15 substantially coincides with one lateral side face 14a of the base 14, but the side face 15b on the wall surface 2 side of the side plate 15 is projected sidewards in a predetermined distance W from the other side face 14b of the base 14. The width of the mat body 13 substantially coincide with the length of the side plate 15. Thus, when the one side face 13a of the mat body 13 is placed in coincidence with the side face 14a of the base 14, the opposite side face 13b of the mat body 13 is projected sidewards in a predetermined distance W from the side face 14b on the wall side of the base 14. Therefore, when the side face 15b of the side plate 15 and the side face 13b of the mat body 13 are contacted with the wall surface 2 in the room, gap 16 is formed between the side faced 14b of the base 14 and the wall surface 2 below the mat 13 as shown in FIG. 5. Two pull-belts 17 for pulling the mat 13 in opposite direction to the wall surface 2 on the bed base 14 are mounted on the side face 13a of the body 13.

FIGS. 6 to 13 show the sequential procedure of making a bed with the mat on which the sheet fastening implements 10, 10 constructed as described above are mounted at both ends of the bed.

Figure 7:
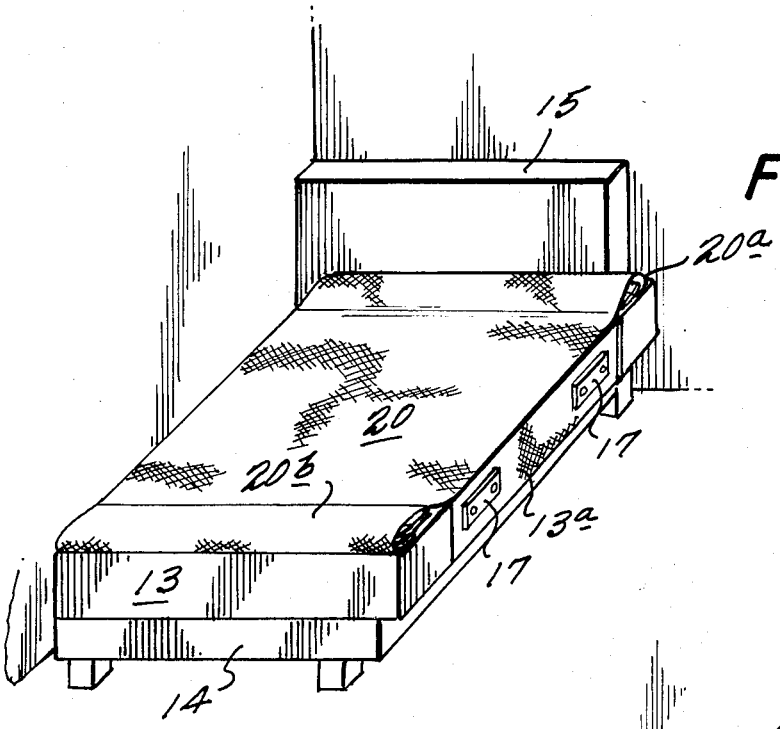

As shown in FIG. 6, first, the pull-belts 17 are held by hands, and the mat 13 is pulled in opposite direction to the wall surface 2. Then, the head end 20a of a sheet 20 having substantially the same width as the width of the mat 13 is tucked in between the implement body 11 and the free portion 12b of the sheet clamping member 12 by raising the latter by hands. When the free portion 12b is released from the hands, the sheet clamping member 12 is restored to the original position by means of its own resiliency, and the end 20a of the sheet 20 is firmly clamped between the free portion 12b of the sheet clamping member 12 and the implement body 11. Then, the leg end 20b of the sheet 20 is similarly clamped between the sheet clamping member 12 and the implement body 11 as shown in FIG. 7.

Figure 8:
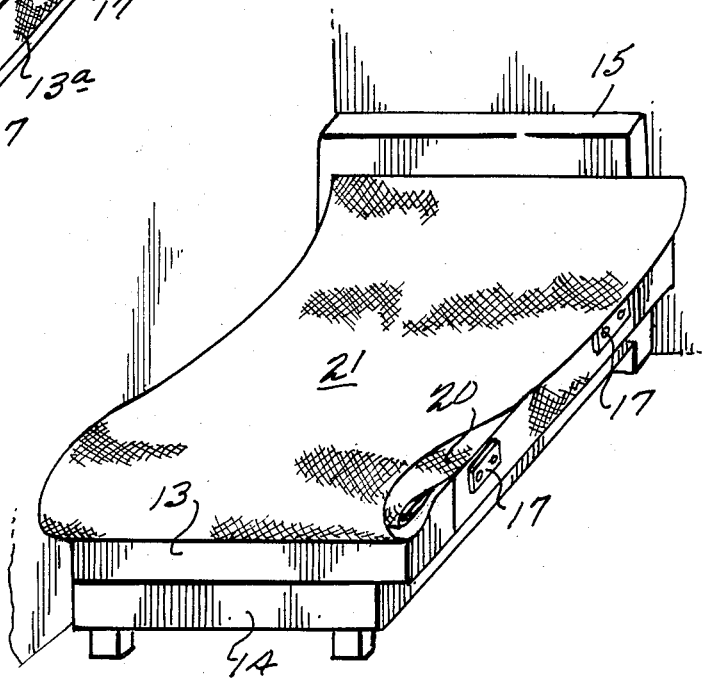
Figure 9:
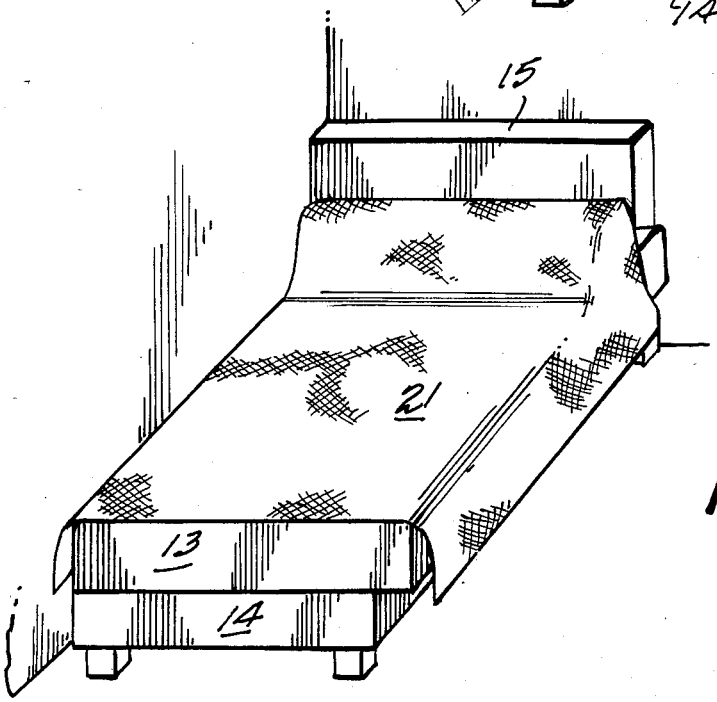

Subsequently, an upper sheet 21 having a width greater than that of the lower sheet 20 is covered on the sheet 20 as shown in FIG. 8, both sides of the sheet 21 are suspended, and the leg end 21b is similarly clamped between the sheet clamping member 12' and the implement body 11 as shown in FIG. 9.

Figure 10:
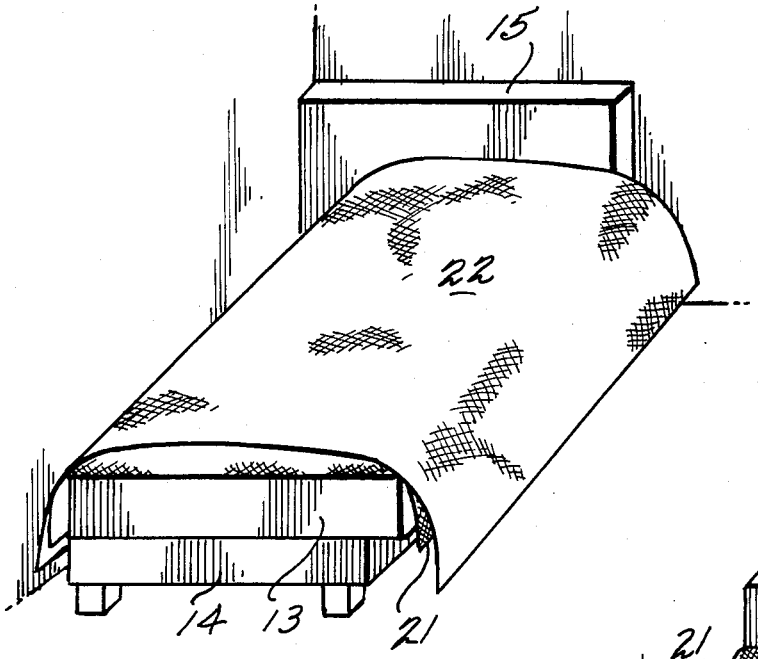
Figure 11:
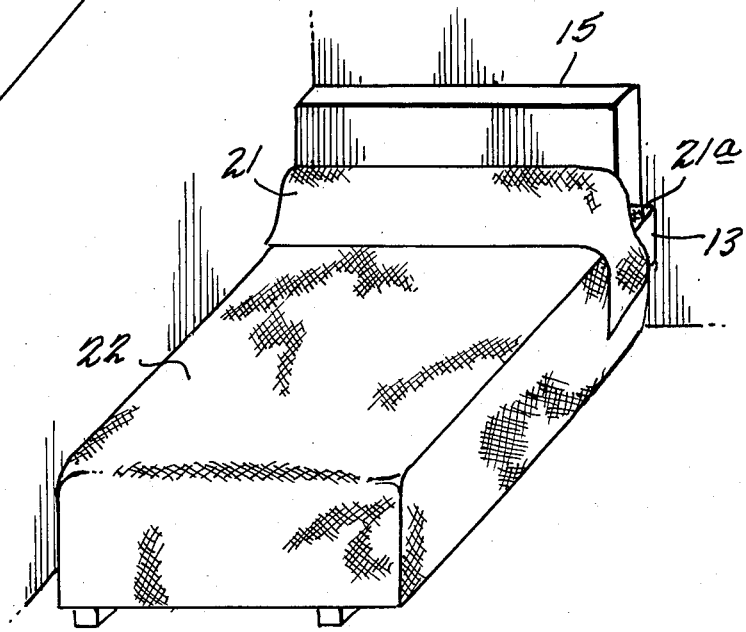
Figure 12:
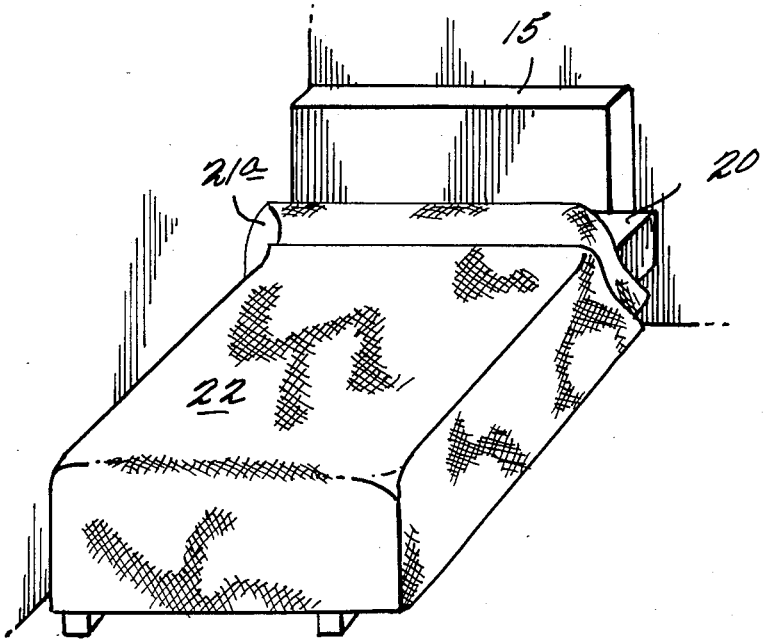
Figure 13:
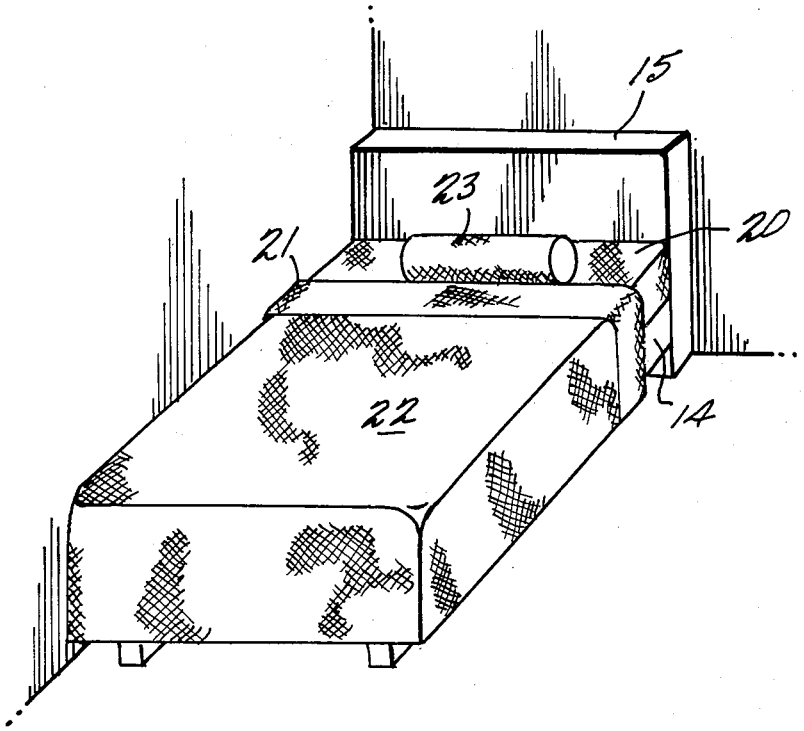
Figure 14:
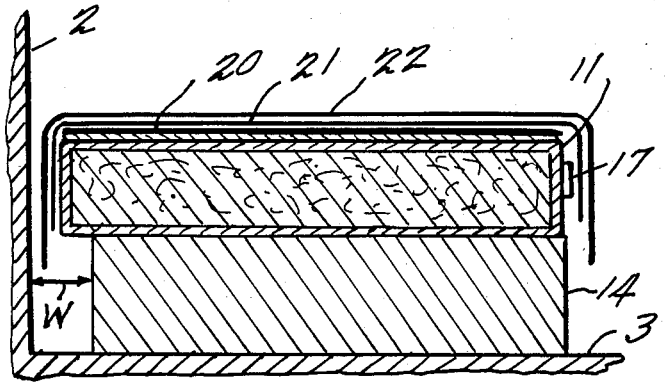
FIG. 14 is a sectional view showing the completion of the bed making work.

Then, as shown in FIG. 10, a blanket 22 is covered on the upper sheet 21, both sides of the blanket 22 are suspended, and the head end 21a of the sheet 21 are folded over the upper surface of the blanket 22 as shown in FIG. 11. Thereafter, as further shown in FIG. 12, the folded end 21a of the upper sheet 21 and the blanket 22 are simultaneously folded over the upper surface of the blanket 22 is shown in FIG. 13. Numeral 23 designates a pillow. FIG. 14 is a sectional view showing the completion of the bed making work. Since the ends of the sheet 21 and the blanket 22 on the wall side are disposed in the gap 16, it is not necessary to tuck them in between the mat 13 and the base 14.

The Way the Invention is Capable of Exploitation in Industry

The present invention is conducive to simplification of a sheet attaching work, and thus very helpful in hotel trades.

Figure 15:
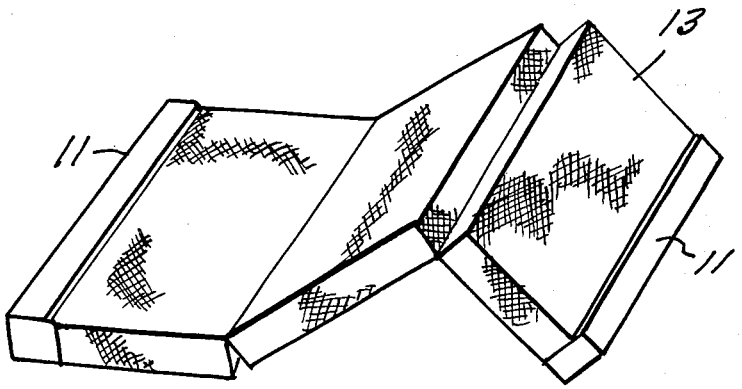
FIG. 15 is a perspective view showing a mat according to another embodiment of the present invention.

The mat according to the present invention is not limited to use with a bed. For example, the mat may be solely used as a mere mattress as shown in FIG. 15.

What is claimed is:

1. In combination:

a bed base having a top surface, head and foot surfaces and side surfaces;

a head plate fixed on said head surface and having a side surface which projects sideward beyond one of said bed base side surfaces;

a mattress slidably positioned on said top surface, said mattress having a top surface, head and foot surfaces and side surfaces and being less in length and greater in width than said bed base so that one of said plate side surfaces may project sideward beyond the corresponding side surface of said bed base, said mattress being provided with a pull-belt on the side surface thereof opposite to said plate one side surface;

two sheet fastening implements on said base top surface, one at each end portion of said mattress, each of said sheet fastening implements comprising a box-like hollow body having top and bottom walls, two side walls and an end wall, said body being open at the other end for receiving the corresponding end portion of said mattress therein; and a strip-shaped sheet clamping member on said body top wall and extending over the entire length thereof, said sheet clamping member having a portion fixed on said body top wall and a free portion resiliently urged into close contact with said body top wall, whereby a sheet can be clamped between said clamping member and said body top wall.

* * * * *